US007300057B1

(12) United States Patent
Franklin

(10) Patent No.: US 7,300,057 B1
(45) Date of Patent: Nov. 27, 2007

(54) SPIN-A-PLAY

(76) Inventor: Jennie Franklin, P.O. Box 517, New York, NY (US) 10031

( * ) Notice: Subject to any disclaimer, the term of this patent is extended or adjusted under 35 U.S.C. 154(b) by 49 days.

(21) Appl. No.: 11/220,317

(22) Filed: Sep. 6, 2005

(51) Int. Cl.
*A63F 3/00* (2006.01)

(52) U.S. Cl. ..... 273/236; 273/308

(58) Field of Classification Search ..... 273/236, 273/299, 308; 434/236, 237, 238
See application file for complete search history.

(56) References Cited

U.S. PATENT DOCUMENTS 5,100,154 A * 3/1992 Mullins ..... 273/429

* cited by examiner

*Primary Examiner*—Vishu K. Mendiratta
(74) *Attorney, Agent, or Firm*—Michael I. Kroll

(57) ABSTRACT

A method for playing a game comprising the steps of selecting a story having a plurality of characters using one of a plurality of spin boards. Thereafter, randomly designating the plurality of characters from the selected story to a plurality of game players using the spin board and acting out the selected story.

5 Claims, 8 Drawing Sheets

SPIN-A-PLAY

BACKGROUND OF THE INVENTION

1. Field of the Invention

The present invention relates to a game, and more specifically, to a game involving the theater and role playing. The game includes at least 3 spin boards, one of which is made from erasable material and comes blank and includes a pen for writing on the blank spin board. The present invention also provides for varying the spinner appearance using "fairy"-fable characters or other graphic images that would appeal to small children or early readers. The spinner may also be enlarged so that it may be placed on an easel for use in a classroom. The game further includes a plurality of play texts and character cards corresponding to the characters in the plays which are stored in a respective one of a plurality of packets. The game also includes a plurality of character card holders, preferably shaped like fortune cookies. Players spin the spinner to determine which play text will be acted out. Upon determining the play text used, players then insert the character cards, corresponding to the selected play, into the character card holders. The character card holders are scrambled. Players then choose a character card holder to determine which character they will play in the scene being acted out.

2. Description of the Prior Art

Numerous other games exist in the prior art. However, no game exists where players randomly choose plays and characters and then re-enact scenes from the plays. It is desirable to have a game that fosters supportive family interactions, in part by not having a loser in the game. It is also desirable to have a game that incorporates fun with reading/learning. While prior art games may be suitable for the particular purpose to which they address, they would not be as suitable for the purposes of the present invention as heretofore described.

SUMMARY OF THE PRESENT INVENTION

The present invention relates to a game, and more specifically, to a game involving the theater and role playing. The game includes at least 3 spin boards, one of which is made from erasable material and comes blank and includes a pen for writing on the blank spin board. The present invention also provides for varying the spinner appearance using "fairy"-fable characters or other graphic images that would appeal to small children or early readers. The spinner may also be enlarged so that it may be placed on an easel for use in a classroom. The game further includes a plurality of play texts and character cards corresponding to the characters in the plays which are stored in a respective one of a plurality of packets. The game also includes a plurality of character card holders, preferably shaped like fortune cookies. Players spin the spinner to determine which play text will be acted out. Upon determining the play text used, players then insert the character cards, corresponding to the selected play, into the character card holders. The character card holders are scrambled. Players then choose a character card holder to determine which character they will play in the scene being acted out.

A primary object of the present invention is to provide a Spin-A-Play game that overcomes the shortcomings of the prior art.

Another, secondary object of the present invention is to provide a Spin-A-Play that fosters positive family interaction.

Another object of the present invention is to provide a Spin-A-Play game that encourages reading.

Still another object of the present invention is to provide a Spin-A-Play game wherein players of different ages can participate.

Yet another object of the present invention is to provide a Spin-A-Play game wherein pre-selected plays are filled in on a spin board.

Still a further object of the present invention is to provide a Spin-A-Play game wherein a blank spin board is provided to allow the players to selectively determine which plays could be selected.

Yet another object of the present invention is to provide a Spin-A-Play game wherein the play includes a play text which details a scene to be acted out and characters to be used when acting out the scene.

An even further object of the present invention is to provide a Spin-A-Play game wherein a packet is provided for housing each respective play text and the character cards for use in acting out that play.

A still further object of the present invention is to provide a Spin-A-Play game wherein each character card represents a character in a play.

A further object of the present invention is to provide a Spin-A-Play game including a plurality of character card holders, preferably formed as fortune cookies for removably retaining character cards therein.

A further object of the present invention is to provide a Spin-A-Play game wherein players choose a fortune cookie and thereby choose the character they will play in the play re-enactment.

Still a further object of the present invention is to provide a Spin-A-Play game wherein the players act out the play that was selected by the spin board.

Yet another object of the present invention is to provide a Spin-A-Play game that is simple and easy to use.

Still yet another object of the present invention is to provide a Spin-A-Play game that is inexpensive to manufacture and operate.

Additional objects of the present invention will appear as the description proceeds.

The present invention overcomes the shortcomings of the prior art by providing a family game where players randomly choose plays and characters and then re-enact scenes from the plays. It is desirable to have a game that fosters supportive family interactions, in part by not having a loser in the game. It is also desirable to have a game that incorporates fun with reading/learning.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
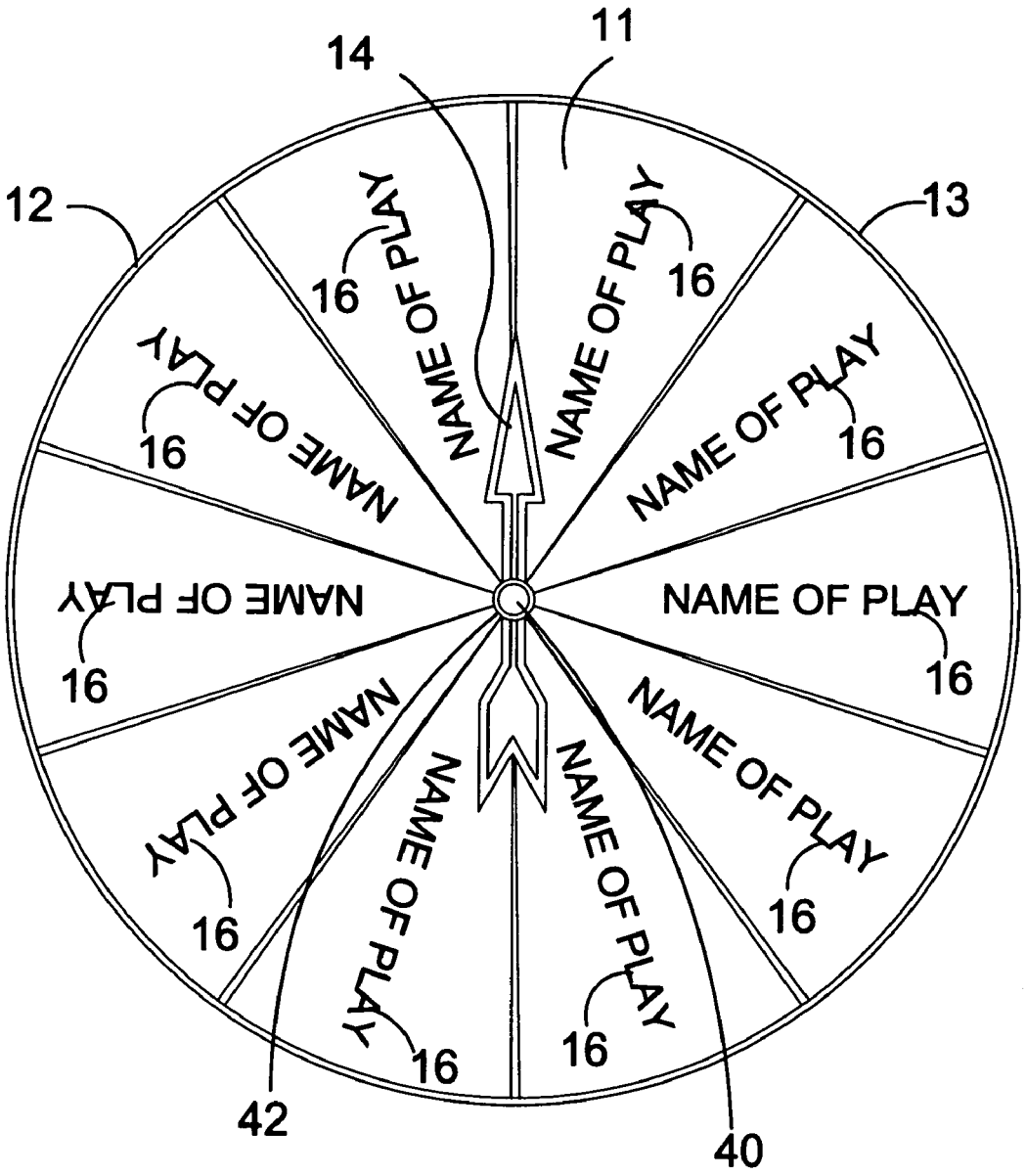
FIG. 1 is a perspective view of the spin board of the Spin-A-Play game of the present invention.

Turning now descriptively to the drawings, in which similar reference characters denote similar elements throughout the several views, the Figures illustrate the Spin-A-Play game of the present invention. With regard to the reference numerals used, the following numbering is used throughout the various drawing Figures.

| | |
|---|---|
| 10 | game of the present invention |
| 11 | top end of spin board |
| 12 | spin board |
| 13 | bottom end of spin board |
| 14 | spinner |
| 15 | sections |
| 16 | play names |
| 18 | character card holder |
| 19 | top side of character card |
| 20 | character card |
| 21 | bottom side of character card |
| 22 | play text |
| 24 | packet |
| 25 | top of blank spin board |
| 26 | blank spin board |
| 27 | bottom of blank spin board |
| 28 | child |
| 30 | blank character cards |
| 32 | flap |
| 34 | flap aperture |
| 36 | fastener |
| 38 | table |
| 40 | pivot |
| 42 | pivot point |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 8 illustrate the Spin-A-Play game of the present invention which is indicated generally by the reference numeral 10.

FIG. 1 is a perspective view of a spin board 12 of the Spin-A-Play game 10 of the present invention. The spin board 12 can be formed in any geometric shape. Shown herein, the spin board 12 is circularly shaped. The spin board 12 has a top end 11 and a bottom end 13. The top end 11 is demarcated into a plurality of equal sized sections 15. Shown herein, there are ten wedge-shaped sections 15. The spin board 12 having ten wedge-shaped sections is shown for purposes of example only and the spin board 12 may include any number of even shaped sections. Alternatively, the section 15 could be unevenly sized or have an alternating patter of even and uneven sized sections 15 therein. In one embodiment of the present invention, a different play name 16 is already displayed in each section 15. A spinner 14 is located in the middle of the spin board 12. The spinner 14 is pivotally connected to the spin board 12 at substantially a center point thereof by a pivot 40. Shown herein, the spinner 14 is shaped like an arrow. However, the spinner 14 may be shaped in any manner that makes readily apparent the section 15 to which it is pointed.

In an alternative embodiment, instead of displaying play names on each section 15 of the spin board 12, characters or graphic images can be displayed to encourage younger people to participate.

The spinner 14 is caused to pivot about pivot point 42 and rotates 360 degrees until the spinner 14 stops within a respective one of the sections 15 on the spin board 12. The game is then played out in a manner that will be discussed hereinafter with specific reference to FIGS. 2-8. After a first user has spun the spinner 14, a second different user repeats the above described process and spins the spinner 14. Players continue this until it is determined and/or decided that the Spin-A-Play game 10 is over.

Figure 2:
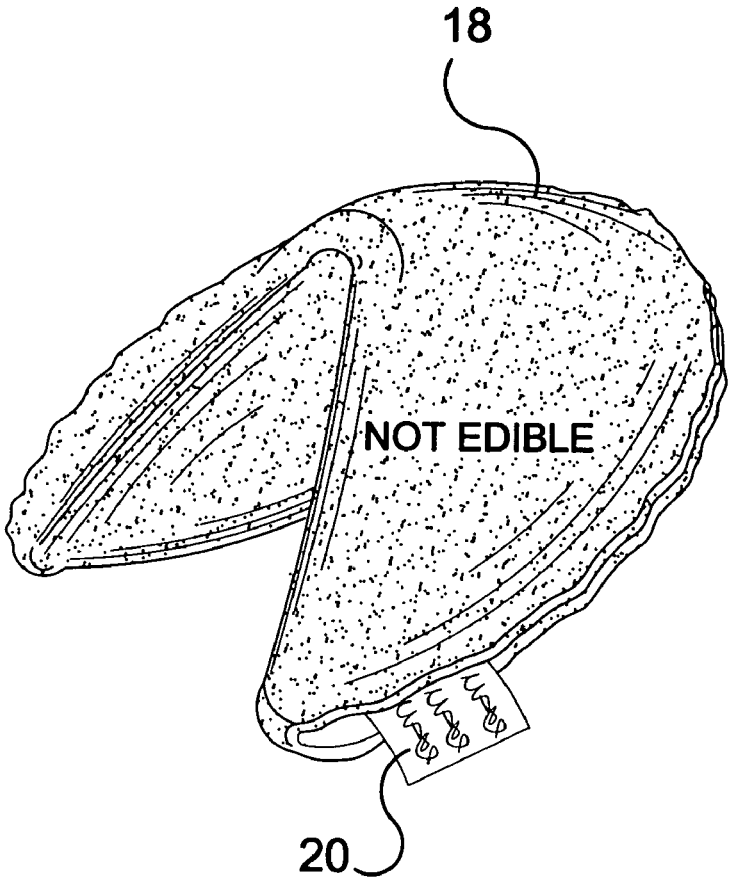
FIG. 2 is a perspective view of the character card holder of the Spin-A-Play game of the present invention.

FIG. 2 is a perspective view of a character card holder 18 of the Spin-A-Play game 10 of the present claimed invention. The character card holder 18 can have a plurality of different shapes. The character card holder 18 is made from a durable material that is non-toxic and non-hazardous to children. Additionally, the character card holder 18 is of a size big enough not to be easily ingested by a child.

The character card holder 18 is a hollow body for retaining a character card 20 therein. The character card holder 18 has at least one opening for easy insertion and removal of the character card 20. At least one edge of the character card 20 sticks out of the opening in the character card holder 18 for easy removal therefrom. Preferably the character card holder 18 is shaped like a fortune cookie. However, the character card holder 18 can be any shape that is aesthetically pleasing, easy to use and able to encourage and foster a happy game play environment.

The character card 20 discloses the name of a character. The names of the characters correspond to the characters in the play selected as described in FIG. 1. The play is selected when the spinner 14 is caused to pivot about pivot point 42. The spinner 14 rotates 360 degrees until the spinner 14 stops within a respective one of the sections 15 on the spin board 12 which determines the play. After a first user has spun the spinner 14, a second different user repeats the above described process and spins the spinner 14. Players continue this until it is determined and/or decided that the Spin-A-Play game 10 is over.

Figure 3:
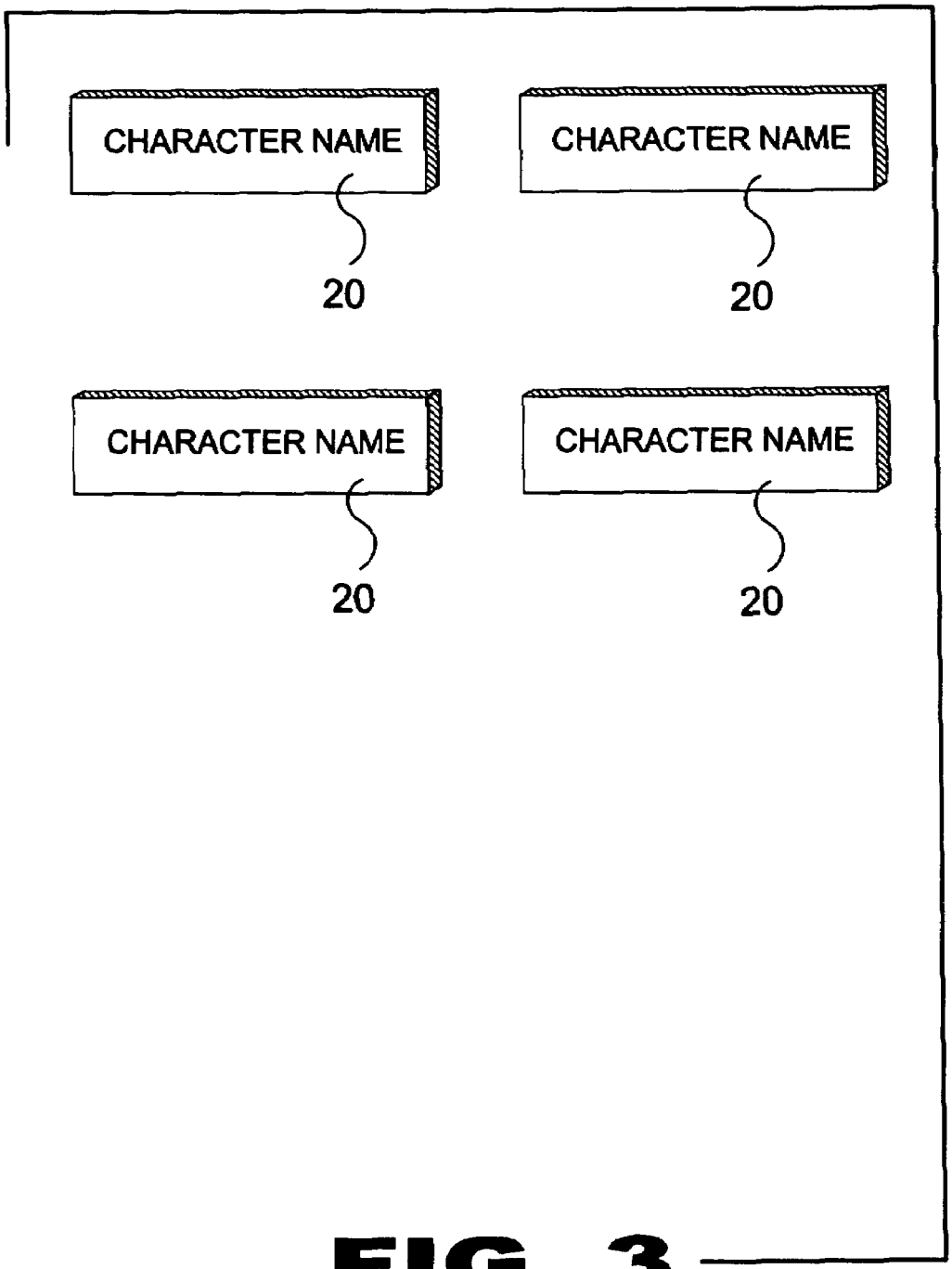
FIG. 3 is a perspective view of the character cards of the Spin-A-Play game of the present invention.

FIG. 3 is a perspective view of the character cards 20 of the Spin-A-Play game 10 of the present claimed invention. Each play associated with the Spin-A-Play game 10 of the present invention includes a plurality of characters to act out. The name of each character to act out is displayed on a top side 19 of the character card 20. The character card 20 is shaped so as to be easily inserted and removed from the character card holder 18. Herein the character cards 20 are rectangular in shape. The name of the character displayed on the character card 20 is displayed such that when an edge of the character card 20 sticks out of the character card holder 18 for easy removal, the character name is not visible to the player.

During the game, after a play has been selected, the character cards 20 associated with that play are inserted into the character card holders 18. The character card holders 18 are scrambled. Each player picks a character card holder 18 from the pile of scrambled character card holders 18. Each player removes the character card 20 from the character card holder 18. The name of the character listed on the character card 20 is the character they will be playing during the re-enactment of the play.

Figure 4:
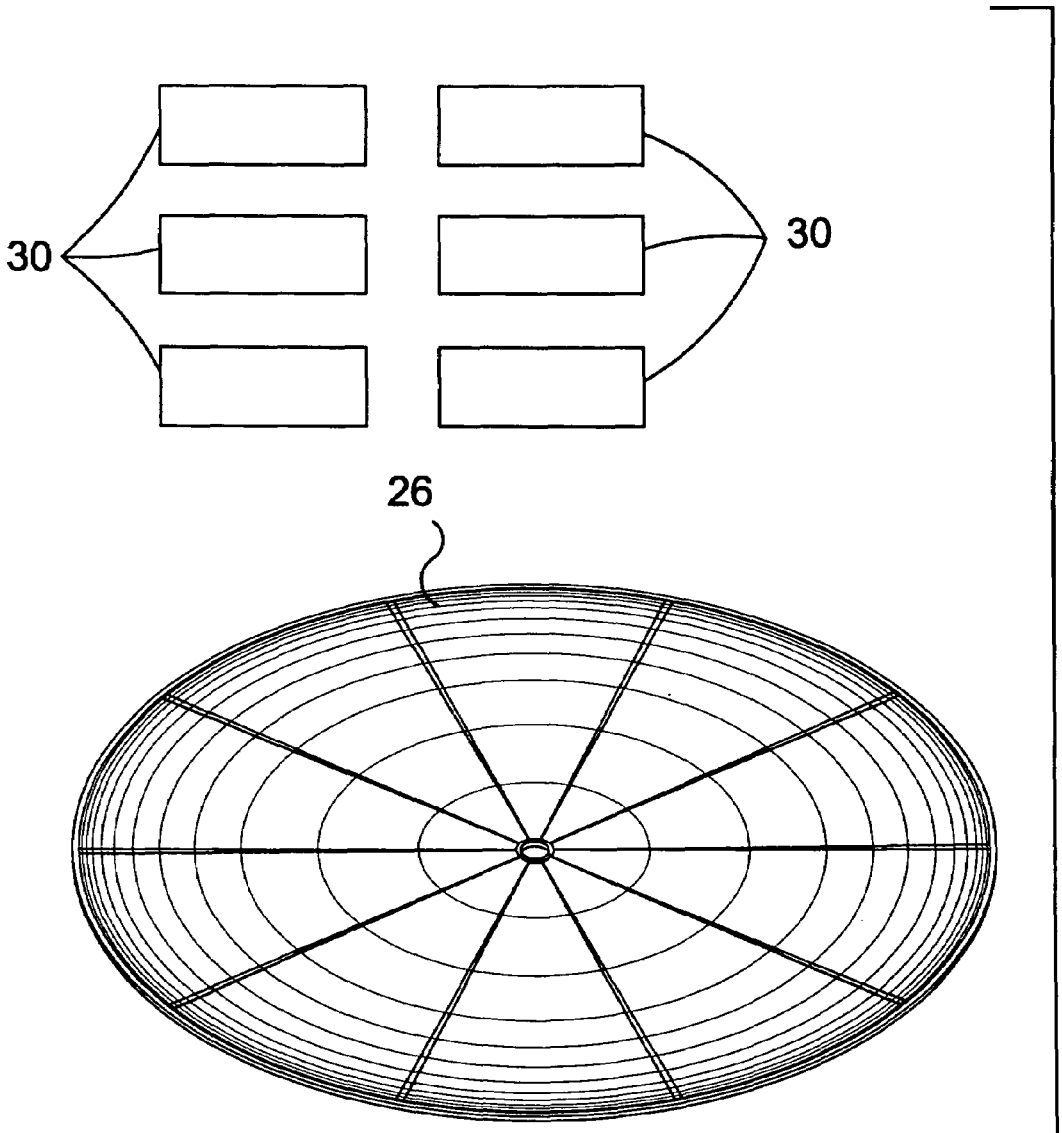
FIG. 4 is a perspective view of the blank spin board of the Spin-A-Play game of the present invention.

FIG. 4 is a perspective view of an alternate embodiment of the Spin-A-Play game 10 of the present claimed invention. Shown herein is a blank spin board 26. The blank spin board 26 has a top end 25 and a bottom end 27. The top end 25 is made from an erasable material. The blank spin board 26 is demarcated into a plurality of equal sized sections 15 similar to the pre-filled in spin board 12 described in FIG. 1. In this embodiment, the user is able to write their own selections 16 in each of the sections 15. This allows the user to incorporate plays from alternate sources, such as from personally drafted plays or from plays not included with the Spin-A-Play game 10.

This embodiment also includes a plurality of blank character cards 30. The blank character cards 30 are similar to the character cards 20 described herein with reference to FIG. 3 except that they are made from an erasable material to permit the users to fill in the characters from the plays from alternate sources.

During game play, the players write the name of a play they would potentially like to act out in each of the blank sections 15 on the blank spin board 26. The spinner 14 is spun, and a play is selected. The players then write the name of a character from the selected play on each of the blank character cards 30. These character cards 30 are inserted into inserted into the character card holders 18. The character card holders 18 are scrambled. Each player picks a character card holder 18 from the pile of scrambled character card holders 18. Each player removes the character card 30 from the character card holder 18. The name of the character listed on the character card 30 is the character they will be playing during the re-enactment of the play.

Figure 5:
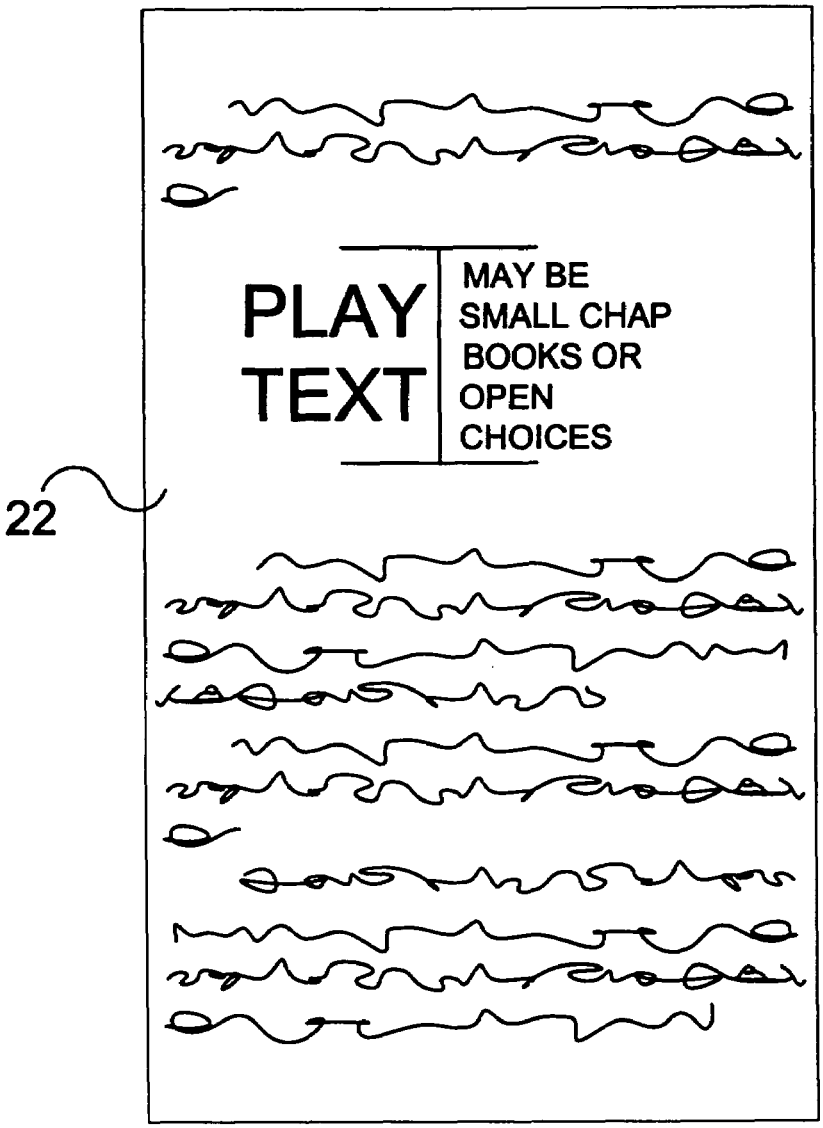
FIG. 5 is a perspective view of the play text of the Spin-A-Play game of the present invention.

FIG. 5 is a perspective view of a play text 22 of the Spin-A-Play game 10 of the present claimed invention. Each play text 22 details a play and includes lines for each of the characters in the play. In an alternate embodiment, each play text 22 includes several versions of the play for use with different numbers of characters to be acted out. This is useful when only 2 people want to act out the play but the play in the original format calls for 5 people to act out the play. The Spin-A-Play game 10 of the present invention includes the number of play texts 22 equal to the maximum number of possible characters to act out in that particular play. For example, if the players can act out Chicken Little using 5 characters, 4 characters, 3 characters or 2 characters, the game will include 5 Chicken Little play texts 22.

The Spin-A-Play game 10 of the present invention can be used in a plurality of situations. For example, the game 10 could be used in a classroom to teach reading skills, creative writing skills, history lessons, literature, values, social interactions and public speaking. The game 10 could also be used at birthday parties and other family get-togethers. Alternatively, the game 10 could be used during children's playdates or in camps on rainy days.

Figure 6:
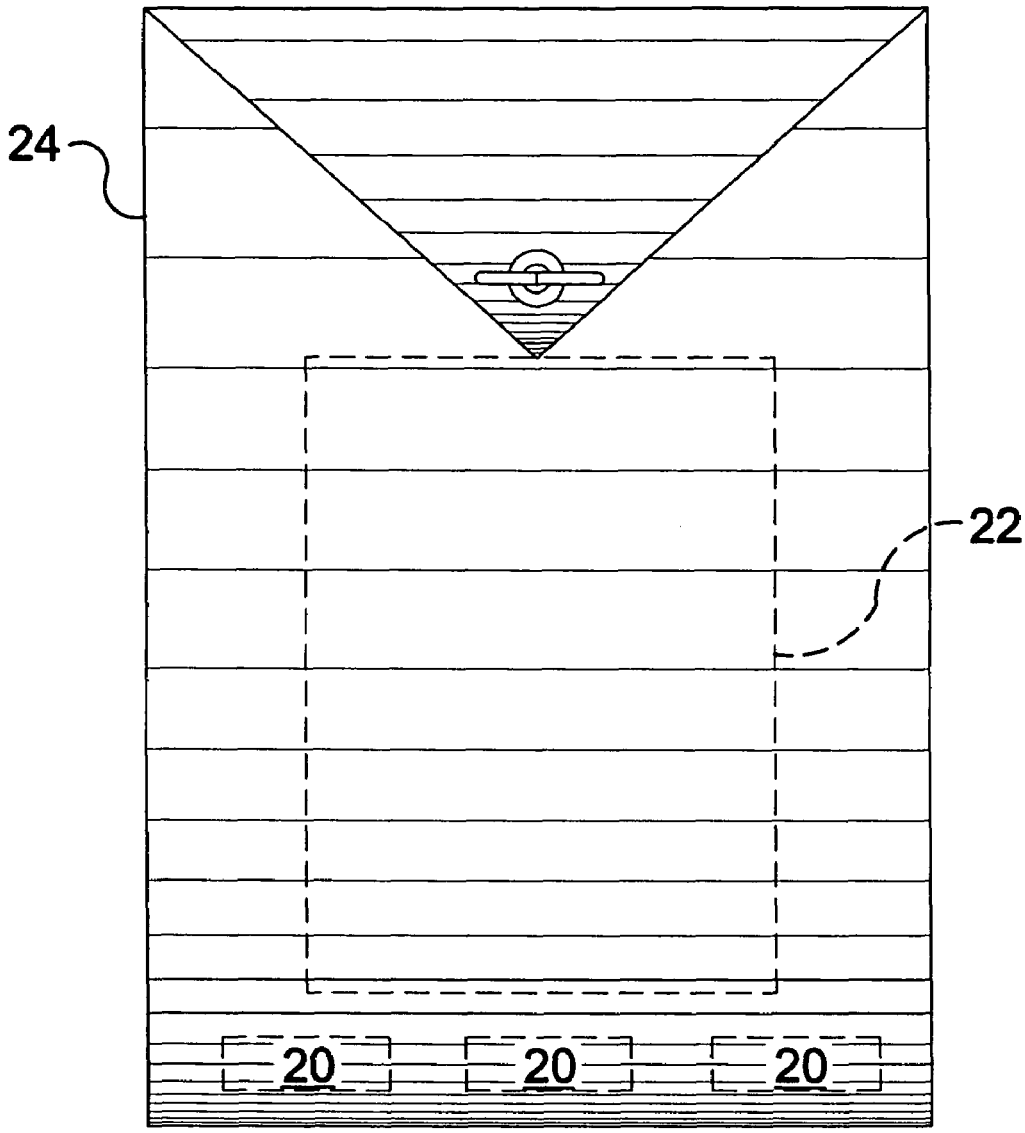
FIG. 6 is a perspective view of the packet and it's contents of the Spin-A-Play game of the present invention.

FIG. 6 is a perspective view of a packet 24 of the Spin-A-Play game 10 of the present claimed invention. Each play included with the Spin-A-Play game 10 is contained within a respective packet 24. When the particular play is not in use, the packet 24 houses the plurality of play texts 22 and the character cards 20. Shown herein, the packet 24 is rectangular in shape. However, the packet 24 can be of any geometric shape provided that it retains the play texts 22 and character cards 20 therein. The packet 24 includes an opening at one end thereof for inserting and removing the packet 24 contents. Located near the open end of the packet 24 is a fastener 36. The packet 24 includes a selectively closable flap 32 at the open end thereof. The flap 32 is attached at one end to the packet 24. Shown herein, the flap 32 contains an aperture 32. When the fastener 36 and the aperture 32 are aligned and secured, the contents of the packet 24 cannot fall out.

The game 10 is also selectively expandable. For example, the packets 24 could be sold separately or obtained over a communication network such as the Internet wherein the packets 24 are able to be downloaded from at least one of the world wide web, FTP site and a newsgroup. The packets 24 could also come in a variety of different age ranges so that age-appropriate stories are available. It would also be possible to tie-in a play with one of the popular television personalities at the time, such as Dora the Explorer. In terms of educational purposes, a packet having a play text describing the meeting of the first Continental Congress or the text from the Scarlet Letter could be included. These scenarios are described for purposes of example only and any scenario can be included in a respective one of the packets 24 for use with the spin-a-play 10 of the present invention.

Figure 7:
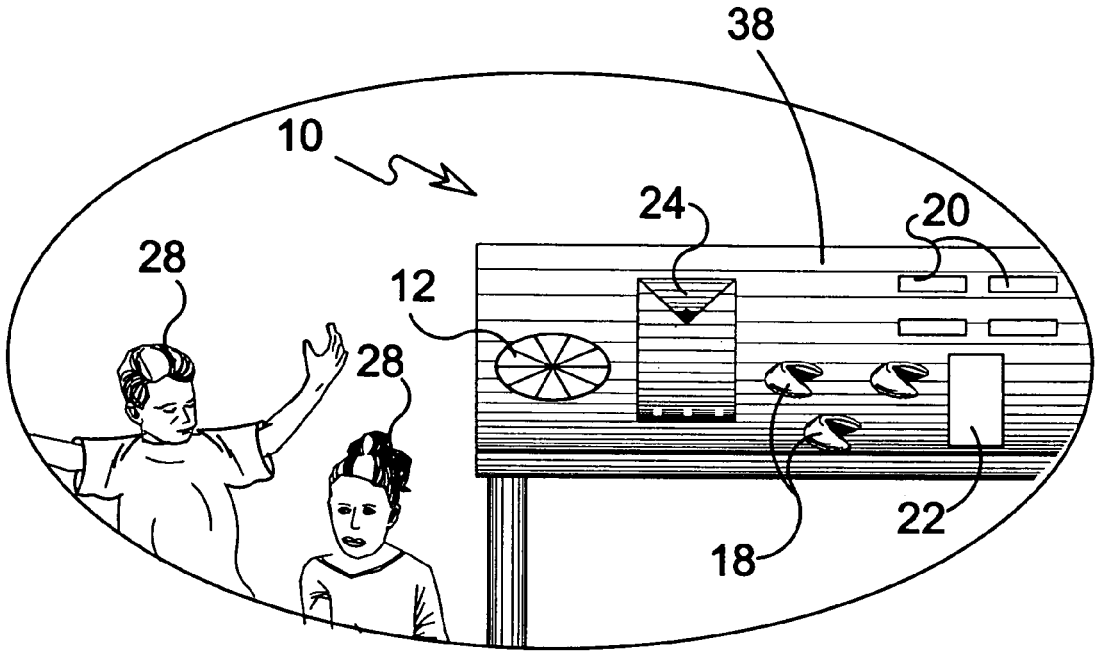
FIG. 7 is an illustrative view of the Spin-A-Play game of the present invention.

FIG. 7 is an illustrative view of the Spin-A-Play game 10 of the present invention. The Spin-A-Play game 10 of the present invention includes a plurality of packets 24, a plurality of blank character cards 30, and a plurality of spin boards 12, including a blank spin board 26. Each packet 24 houses a plurality of play texts 22 and a plurality of character cards 20 corresponding to the characters in the respective play text 22.

Shown herein, two children 28 are acting out a play. The children 28 have spun the spinner 14 of the spin board 12, thereby selecting a play to re-enact. They then emptied the contents of the packet 24 corresponding to the selected play onto a table 38. The children 28 inserted the character cards 20 into the character card holders 18 and shuffled them. Each child 28 chose a character card holder 18 and removed the character card 20 therefrom to ascertain which character they would be playing. Using the play texts 22, the children 28 act out the play.

Figure 8:
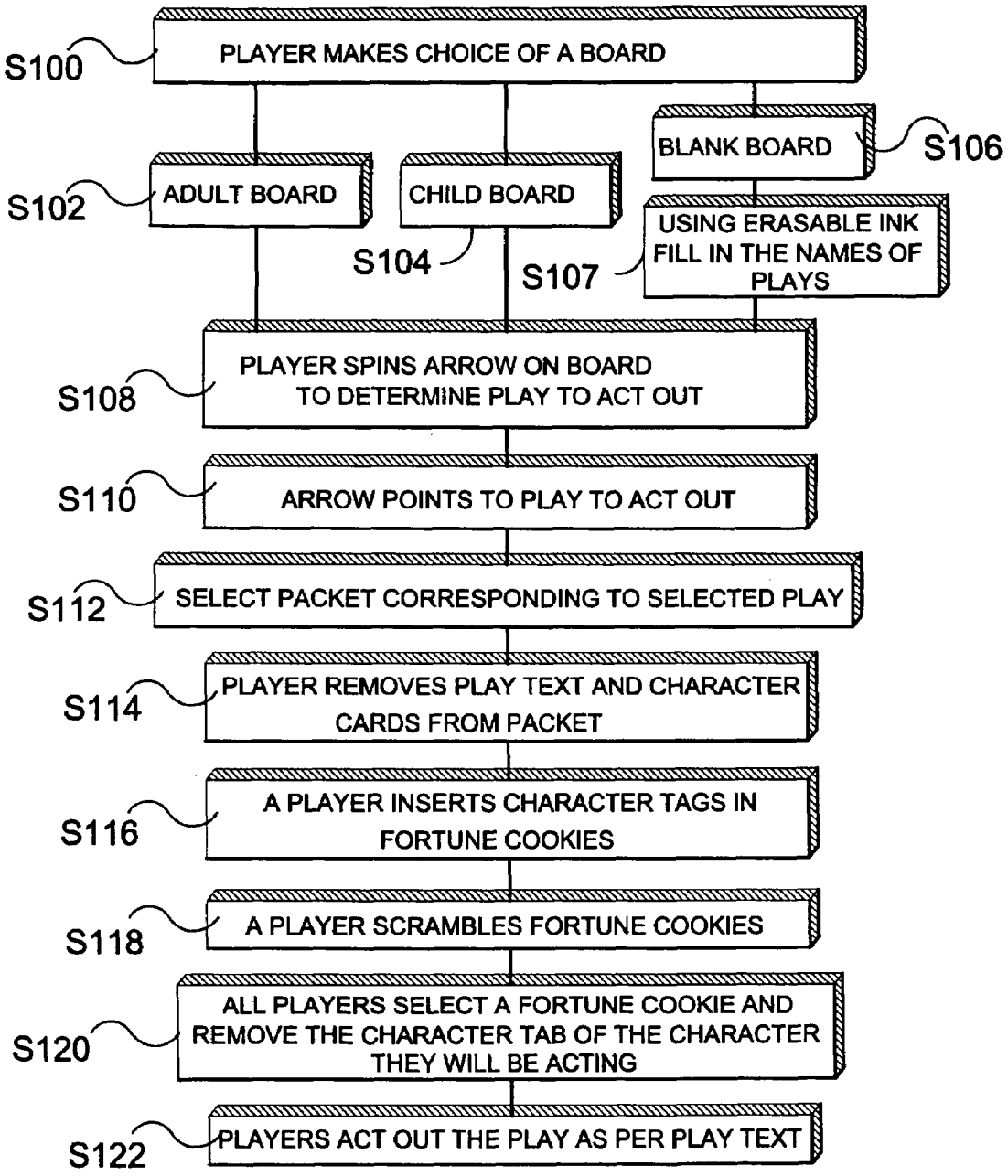
FIG. 8 is a flow diagram detailing the manner in which players play the Spin-A-Play game of the present invention.

FIG. 8 is a flow diagram detailing the manner in which players play the Spin-A-Play game 10 of the present invention. In step S100, the players decide which spin board to use. Upon completion of step S100, there are three potential choices of spin boards that could be made. In step S102, the player chooses an adult spin board having adult play options. In step S104, the player chooses a child spin board having child age appropriate plays. In Step S106, the player chooses a blank spin board wherein the players are able to fill in the desired plays. Should the player choose a blank spin board as shown in step S106, the player then uses erasable ink to fill in the name of each play in the demarcated sections 15 thereon as shown in step S107. After completing any of step S102, S104, and S107, the game proceeds at step S108 where the players spin the spinner on the spin board to determine which play to act out. When the spinner stops spinning as shown in step S110, a first end thereof points to a play which the players are required to act out. In step S112, the players select the packet corresponding to the selected play shown in the section on the spin board. The players remove the play texts and the character cards from the packet in step S114. The character cards are inserted into the character card holders in step S116. In step S118, the character card holders are scrambled. In step S120, each player selects a character card holder and removes the character card to determine which character they will be playing. The players act out the play as per the play text in step S122. The game 10 as shown herein can be selectively repeated in any variation beginning of step S100 or any other step described hereinabove.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A method for playing a game not having a loser comprising the steps of:

a. a player spinning an arrow on a spin board to select a story from one of a number of stories on said spin board;

b. selecting a packet corresponding to the selected story from the spin board, the packet containing a card for each character in the selected story and a script sheet for each character;

c. withdrawing the character cards from the selected packet and placing each character card in a separate card holder wherein the character is hidden from view;

d. scrambling the separate card holders;

e. each player selecting a card holder and withdrawing the character card therein for determining the character to be acted out by each player;

f. each player withdrawing a script sheet from said selected packet for the character to be acted out by each player; and g. each player acting out the character assigned using the script sheet for the assigned character, thereby fostering family interactions that combines fun with reading and learning.

2. The method of claim 1 wherein a blank spin board is initially selected and filled in prior to use.

3. The method of claim 2, wherein said step of selecting the blank spin board further includes the step of inserting story indicators into a plurality of slots provided on the blank spin board.

4. The method of claim 1, wherein said step of acting said selected story further comprises reviewing, by each player, the play text corresponding to the character listed on the selected character card.

5. The method of claim 4, wherein each card holder is in the shape of a fortune cookie with an opening to receive a character card.

* * * * *